US011291344B2

(12) United States Patent
Killi

(10) Patent No.: US 11,291,344 B2
(45) Date of Patent: Apr. 5, 2022

(54) SURFACE TREATMENT TOOL

(71) Applicant: Motorscrubber Limited, Sheffield (GB)

(72) Inventor: Imre Killi, Sheffield (GB)

(73) Assignee: Motorscrubber Limited, South Yorkshire (GB)

( * ) Notice: Subject to any disclaimer, the term of this patent is extended or adjusted under 35 U.S.C. 154(b) by 386 days.

(21) Appl. No.: 16/334,484

(22) PCT Filed: Sep. 12, 2017

(86) PCT No.: PCT/GB2017/052662
§ 371 (c)(1),
(2) Date: Mar. 19, 2019

(87) PCT Pub. No.: WO2018/055335
PCT Pub. Date: Mar. 29, 2018

(65) Prior Publication Data

US 2019/0208977 A1 Jul. 11, 2019

(30) Foreign Application Priority Data

Sep. 23, 2016 (GB) ..... 1616234

(51) Int. Cl.

| | |
|---|---|
| ***A47L 11/30*** | (2006.01) |
| ***A47L 11/202*** | (2006.01) |
| ***A47L 11/20*** | (2006.01) |
| ***A47L 11/292*** | (2006.01) |

(Continued)

(52) U.S. Cl.
CPC ..... *A47L 11/302* (2013.01); *A47L 11/201* (2013.01); *A47L 11/202* (2013.01); *A47L 11/283* (2013.01);

(Continued)

(58) Field of Classification Search
CPC .... A47L 11/302; A47L 11/201; A47L 11/202; A47L 11/283; A47L 11/292;

(Continued)

(56) References Cited

U.S. PATENT DOCUMENTS

| | | | |
|---|---|---|---|
| 2,495,686 | A | 1/1950 | Berberian |
| 2,923,956 | A | 2/1960 | Bixler |

(Continued)

FOREIGN PATENT DOCUMENTS

| | | | |
|---|---|---|---|
| CN | 204306752 | U | 5/2015 |
| EP | 0931501 | A2 | 7/1999 |

(Continued)

*Primary Examiner* — David Redding
(74) *Attorney, Agent, or Firm* — The Webb Law Firm

(57) ABSTRACT

A portable surface treatment tool is provided, which is configured for attachment to a suction controller. The portable surface treatment tool is configured for use with vertical, overhead, inclined and horizontal surfaces and includes a head and a handle coupled to the head. The head includes: a rotatable surface treatment unit configured to engage a surface to be treated; a motor configured to drive the rotatable surface treatment unit; and a shroud substantially encasing at least a portion of the rotatable surface treatment unit, the shroud defining a suction region proximal the rotatable surface treatment unit. The suction region is configured to suck fluid from a surface to be treated. The shroud defines a suction connection formation configured to be coupled to a source of suction supplied by a suction controller, the suction connection formation being in fluid communication with the suction region to remove fluid from a surface to be treated.

20 Claims, 13 Drawing Sheets

(51) Int. Cl.

| | |
|---|---|
| ***A47L 11/293*** | (2006.01) |
| ***A47L 11/283*** | (2006.01) |
| ***A47L 11/40*** | (2006.01) |

(52) U.S. Cl.

CPC ..... *A47L 11/292* (2013.01); *A47L 11/293* (2013.01); *A47L 11/4005* (2013.01); *A47L 11/4044* (2013.01); *A47L 11/4069* (2013.01); *A47L 11/4075* (2013.01); *A47L 11/4077* (2013.01); *A47L 11/4083* (2013.01); *A47L 11/4088* (2013.01)

(58) Field of Classification Search

CPC ..... A47L 11/293; A47L 11/4005; A47L 11/4044; A47L 11/4069; A47L 11/4075; A47L 11/4077; A47L 11/4083; A47L 11/4088; A47L 7/0004; A47L 7/0009; A47L 11/305; A47L 11/34; A47L 11/38; A47L 11/4094

See application file for complete search history.

(56) References Cited

U.S. PATENT DOCUMENTS

| | | | |
|---|---|---|---|
| 3,686,707 | A | 8/1972 | Hughes et al. |
| 4,893,375 | A | 1/1990 | Girman et al. |
| 5,289,605 | A | 3/1994 | Armbruster |
| 5,993,563 | A | 11/1999 | Strickland et al. |
| 2001/0049854 | A1 | 12/2001 | Dalbey |
| 2007/0209141 | A1 | 9/2007 | Hare |
| 2015/0136176 | A1 | 5/2015 | Aldrich |

FOREIGN PATENT DOCUMENTS

| | | | |
|---|---|---|---|
| EP | 1925401 | A1 | 5/2008 |
| FR | 2703285 | B1 | 6/1995 |
| JP | 7116099 | A | 5/1995 |
| WO | 9315646 | A1 | 8/1993 |
| WO | 2015073914 | A1 | 5/2015 |
| WO | 2016059562 | A1 | 4/2016 |

SURFACE TREATMENT TOOL

CROSS-REFERENCE TO RELATED APPLICATIONS

This application is the United States national phase of International Application No. PCT/GB2017/052662 filed Sep. 12, 2017, and claims priority to United Kingdom Patent Application No. 16162343.9 filed Sep. 23, 2016, the disclosures of which are hereby incorporated by reference in their entireties.

FIELD

The present disclosure relates to a portable surface treatment tool, surface treatment systems including said portable surface treatment tool and a kit of parts for providing a surface treatment system.

BACKGROUND

Cleaning apparatuses for cleaning surfaces are known. One known apparatus is a floor scrubber dryer, which can be in the form of a walk behind machine or a ride on machine. Such machines are suitable for cleaning large open areas, for example in an airport or other large space. However, it is not possible to clean smaller, more difficult to access areas, such as stairs, floor edges adjacent walls, washrooms, or surfaces beneath fixed furniture, with such a machine. Therefore a user is required obtain and use additional equipment, for example a mop or other machine, to clean these areas. This increases the time required to complete the required cleaning and the associated cost.

The present disclosure aims to reduce or overcome such problems.

SUMMARY

In a first aspect portable surface treatment tool is provided which is configured for attachment to a scrubber dryer machine, the portable surface treatment tool being configured for use with vertical, overhead, inclined and horizontal surfaces, the portable surface treatment tool comprising a head and a handle coupled to said head, wherein the head comprises:

- a rotatable surface treatment unit configured to engage a surface to be treated;
- a motor configured to drive the rotatable surface treatment unit; and
- a shroud containing at least a portion of the rotatable surface treatment unit, the shroud defining a suction region proximal the rotatable surface treatment unit wherein the suction region is configured to suck fluid from a surface to be treated, and wherein the shroud defines a suction connection formation configured to be coupled to a source of suction supplied by said scrubber dryer machine, the suction connection formation being in fluid communication with the suction region to remove fluid from a surface to be treated.

Optionally the shroud comprises resilient guide members configured to direct fluid flow on a surface towards the suction region.

Optionally the suction region is defined by the resilient guide members.

Optionally at least a portion of the resilient guide members defining the suction region and proximal the rotatable surface treatment unit comprises openings for fluid to enter the suction region.

Optionally the suction region is provided at a first portion of a perimeter of the shroud and a resilient guide member configured to direct fluid flow on a surface is provided at a second portion of the perimeter of the shroud, wherein the first and second portions are provided opposite each other around the perimeter of the shroud.

Optionally the suction region is defined by resilient guide members which are configured to direct fluid flow on a surface, and wherein the resilient guide member provided at the second portion of the perimeter comprises an additional resilient guide member.

Optionally the resilient guide members defining the suction region and the additional resilient guide member are arranged to extend away from the shroud, towards a surface to be treated when in use, and wherein the resilient guide members defining the suction region and the additional resilient guide member are arranged to extend around the perimeter of the shroud such that they define gaps between the resilient guide members defining the suction region and the additional resilient guide member.

Optionally the resilient guide members defining the suction region and the additional resilient guide member are arranged to extend away from the shroud, towards a surface to be treated when in use, and wherein the resilient guide members defining the suction region at the first portion of the shroud perimeter extend away from the shroud by a greater distance than the additional resilient guide member provided at the second portion of the perimeter.

Optionally, the resilient guide members defining the suction region are spring mounted on the shroud. Optionally the additional resilient guide member is spring mounted on the shroud. This is beneficial since the position of the resilient guide members and/or the additional resilient guide member can adjust in response to variation in the depth of the rotatable surface treatment unit (e.g. brushes or cleaning pads). In this way, the portable surface treatment tool is suitable for use with a range of rotatable surface treatment units, without requiring adjustment of the position of the resilient guide members and/or the additional resilient guide member.

Optionally the portable surface treatment tool comprises a power connector configured to couple the motor to an external power supply to drive the rotatable surface treatment unit.

Optionally the handle is an elongate handle arranged such that an end of the elongate handle is coupled to the head of the tool.

Optionally the tool includes:

a) a suction hose coupled to the suction connection formation of the shroud, wherein an end of the suction hose distal the shroud is configured to couple to said scrubber dryer machine, optionally wherein the suction hose is configured to extend through or along a shaft of the elongate handle; and/or b) a power supply cable coupled between the motor and the or a power connector configured to couple to an external power supply, the power connector provided distal the tool head, wherein the power supply cable is provided through or along a shaft of the handle; and/or c) a fluid applicator mounted on the head of the tool, wherein the fluid applicator is configured to apply fluid to a surface to be treated, optionally wherein the tool further comprises a fluid supply pipe coupled to the fluid applicator and extending through or along a shaft of the handle, terminating at a fluid supply connector configured to couple to a fluid supply.

Optionally the or a power cable and/or the or a fluid supply pipe extend through an interior hollow of the suction hose or is integrally formed with the suction hose.

In a second aspect a surface treatment system is provided comprising a portable surface treatment tool as disclosed herein, further comprising a scrubber dryer machine comprising a source of suction and configured to be coupled to the suction connection formation of the portable surface treatment tool to remove fluid from the suction region.

Optionally the system further comprises the or a power supply configured to power the motor to drive the rotatable surface treatment unit.

Optionally the system further comprises a fluid reservoir configured to be coupled to the or a fluid applicator mounted on the head of the tool and configured to apply fluid to a surface to be treated, optionally wherein the fluid reservoir is configured to be coupled to the fluid applicator via a pump.

Optionally the or a power supply and/or the or a fluid reservoir and/or the or a pump is provided by the scrubber dryer machine.

In a third aspect a kit of parts for providing a surface treatment system is provided, the kit comprising a portable surface treatment tool as disclosed herein.

Optionally the kit further comprises a suction hose configured to couple the suction connection formation of the portable surface treatment tool to a scrubber dryer machine to remove fluid from the suction region of the tool when in use.

Optionally the kit comprises a pump configured to couple the or a fluid reservoir to the fluid applicator configured to be mounted on the head of the tool and configured to apply fluid to a surface to be treated in use.

In a fourth aspect a shroud for a portable surface treatment tool is provided comprising a rotatable surface treatment unit, wherein the shroud is configured for attachment to a portable surface treatment tool, the shroud defining a suction region wherein the suction region is configured to suck fluid from a surface to be treated, and wherein the shroud defines a suction connection formation configured to be coupled to a source of suction supplied by a scrubber dryer machine, the suction connection formation being in fluid communication with the suction region to remove fluid from a surface to be treated.

In a further aspect, a portable surface treatment tool is provided and is configured for attachment to a suction controller, the portable surface treatment tool being configured for use with vertical, overhead, inclined and horizontal surfaces, the portable surface treatment tool comprising a head and a handle coupled to said head, wherein the head comprises:

- a rotatable surface treatment unit configured to engage a surface to be treated;
- a motor configured to drive the rotatable surface treatment unit; and
- a shroud substantially encasing at least a portion of the rotatable surface treatment unit, the shroud defining a suction region proximal the rotatable surface treatment unit wherein the suction region is configured to suck fluid from a surface to be treated, and wherein the shroud defines a suction connection formation configured to be coupled to a source of suction supplied by a suction controller, the suction connection formation being in fluid communication with the suction region to remove fluid from a surface to be treated.

The portable surface treatment tool disclosed herein provides a compact tool which is arranged to both treat a surface, e.g. clean, and to remove fluid from a surface. Accordingly both treatment and drying is achieved by the tool. The portable surface treatment tool includes a shroud which is configured to contain at least a portion of the rotatable surface treatment unit and also to define the suction region from which fluid can be removed from a surface. In this way, treatment of the surface and suction of fluid from the surface are provided in close proximity within the region defined by the shroud. This results in a compact and effective treatment/drying head which can be used to treat, e.g. clean, small or difficult to access areas which can be awkward to treat and which a larger machine would not be able to access.

The positioning of the suction region proximal the rotatable surface treatment unit also has the advantage that any fluid applied to a surface can be more rapidly removed following treatment by the surface treatment unit since there is the reduced likelihood of fluid flowing across the surface and away from the suction region. In this way, treatment fluid is more effectively retained and removed from the region defined by the shroud.

The portable surface treatment tool is capable of effectively treating and drying a surface without requiring a source of suction or reservoir for fluid removed from a surface to be carried on the tool. This enables the tool to be lightweight such that it can be easily manipulated and lifted by a user to treat and dry difficult to reach areas.

Optionally the shroud comprises resilient guide members configured to direct fluid flow on a surface towards the suction region. In this way, more effective fluid removal is achieved Optionally the suction region is defined by the resilient guide members.

Optionally at least a portion of the resilient guide members defining the suction region and proximal the rotatable surface treatment unit comprises openings for fluid to enter the suction region. This enables fluid on the surface to enter the suction region more easily whilst still enabling effective directing of the fluid by the resilient guide members.

Optionally the suction region is provided at a first portion of a perimeter of the shroud and a resilient guide member configured to direct fluid flow on a surface is provided at a second portion of the perimeter of the shroud, wherein the first and second portions are provided opposite each other around the perimeter of the shroud. The provision of a resilient guide member in a position on the shroud opposite the suction region provides effective guiding of fluid on a surface towards the suction region. As a result, guide members need not be provided between the suction region at the first portion of the shroud and the resilient guide member at the second portion of the shroud. In this way, gaps between the resilient members are provided. This enables the rotatable surface treatment unit, for example brushes mounted thereon, to approach more closely edges or corners that require treatment, thereby facilitating treatment of more awkward areas, for example stairs and washroom facilities.

Optionally the suction region comprises a channel provided around a perimeter of the shroud. By providing the suction region in the form of a channel around the perimeter of the shroud, fluid can be removed from a surface irrespective of the direction in which the portable surface treatment tool is moved across the surface. In this way, fluid can be effectively removed in the region defined by the shroud regardless of the direction in which a user moves the tool across a surface.

Optionally the resilient guide members comprise rubber blades, for example squeegees. The use of squeegees facilitate directing of fluid on a surface towards the suction region.

Optionally the portable surface treatment tool comprises a power connector configured to couple the motor to an external power supply to drive the rotatable surface treatment unit. By connecting to an external power supply, a battery or other power supply need not be provided on the tool itself. Accordingly, the weight of the tool is reduced making the tool more lightweight and easier for a user to manipulate or lift to treat, for example, overhead, inclined or vertical surfaces. In alternative embodiments, the tool may comprise a battery to power the motor to drive the rotatable surface treatment unit.

Optionally the handle is an elongate handle arranged such that an end of the elongate handle is coupled to the head of the tool.

Optionally the tool includes a suction hose coupled to the suction connection formation of the shroud, wherein an end of the suction hose distal the shroud is configured to couple to a suction controller.

Optionally the suction hose is configured to extend through or along a shaft of the elongate handle. This provides a neater tool arrangement which is both aesthetically pleasing and wherein the suction hose does not interfere or get in the way of treatment of a surface.

Optionally the tool comprises a power supply cable coupled between the motor and the power connector configured to couple to an external power supply, the power connector provided distal the tool head, wherein the power supply cable is provided through or along a shaft of the handle. This provides a neater tool arrangement which is both aesthetically pleasing and wherein the power supply cable does not interfere or get in the way of treatment of a surface.

Optionally the tool further comprises a fluid applicator mounted on the head of the tool, wherein the fluid applicator is configured to apply fluid to a surface to be treated.

Optionally the tool further comprises a fluid supply pipe coupled to the fluid applicator and extending through or along a shaft of the handle, terminating at a fluid supply connector configured to couple to a fluid supply. Again, provision of the fluid supply pipe through or along the handle provides a neater tool arrangement which is both aesthetically pleasing and wherein the fluid supply pipe does not interfere or get in the way of treatment of a surface.

Optionally the tool comprises an actuator configured to activate the fluid applicator to apply fluid to a surface to be treated.

Optionally a power cable and/or a fluid supply pipe extend through an interior hollow of the suction hose or is integrally formed with the suction hose. This again provides a neat and compact arrangement that does not interfere or get in the way of treatment of a surface.

Optionally the tool comprises an actuator configured to activate the rotatable surface treatment unit.

Optionally the tool comprises an actuator configured to activate the application of suction to the suction region.

In a further aspect, a surface treatment system is provided comprising a portable surface treatment tool as disclosed herein.

Optionally the system further comprises a power supply configured to power the motor to drive the rotatable surface treatment unit.

Optionally the portable surface treatment tool comprises a fluid applicator mounted on the head of the tool and configured to apply fluid to a surface to be treated, and wherein the system further comprises a fluid reservoir coupled to the fluid applicator.

Optionally the fluid reservoir is coupled to the fluid applicator via a pump. In this way, the system is not required to rely on gravity to apply fluid to a surface to be treated. Accordingly fluid can be applied to overhead, inclined or vertical surfaces.

Optionally the power supply and/or the fluid reservoir and/or the pump is configured to be wearable by a user. This allows a user to conveniently carry a power supply, a treatment fluid reservoir and/or a pump to be used with the portable surface treatment tool, whilst having both hands free to operate the tool.

Optionally the system comprises a suction controller comprising a source of suction and coupled to the suction connection formation of the portable surface treatment tool to remove fluid from the suction region.

Optionally the suction controller is configured to be wearable by a user.

Optionally the system comprises a suction controller comprising a source of suction and configured to be coupled to the suction connection formation of the portable surface treatment tool to remove fluid from the suction region, wherein the power supply and/or the fluid reservoir and/or the pump is provided by the suction controller. By providing a power supply, fluid reservoir and/or pump such that these are provided by the suction controller, a reduced number of components in the surface treatment system are required. This simplifies the system. This can also reduce the number of components which a user is require to carry.

Optionally the suction controller comprises a housing and the power supply and/or the fluid reservoir and/or the pump are provided within the housing.

Optionally the suction controller comprises a scrubber dryer machine, a wet vacuum, or a steam cleaner.

In a further aspect a surface treatment system is provided comprising a portable surface treatment tool as disclosed herein and further comprising a suction controller comprising a source of suction and configured to be coupled to the suction connection formation of the portable surface treatment tool to remove fluid from the suction region.

Optionally the system further comprises a power supply configured to power the motor to drive the rotatable surface treatment unit.

Optionally the portable surface treatment tool comprises a fluid applicator mounted on the head of the tool and configured to apply fluid to a surface to be treated, and wherein the system further comprises a fluid reservoir configured to be coupled to the fluid applicator.

Optionally the fluid reservoir is configured to be coupled to the fluid applicator via a pump. In this way, the system is not required to rely on gravity to apply fluid to a surface to be treated. Accordingly fluid can be applied to overhead, inclined or vertical surfaces.

Optionally the power supply and/or the fluid reservoir and/or the pump is provided by the suction controller. By providing a power supply, fluid reservoir and/or pump such that these are provided by the suction controller, a reduced number of components in the surface treatment system are required. This simplifies the system. This can also reduce the number of components which a user is require to carry.

Optionally the suction controller comprises a housing and the power supply and/or the fluid reservoir and/or the pump are provided within the housing.

Optionally the suction controller comprises a scrubber dryer machine, a wet vacuum or a steam cleaner.

Optionally the suction controller comprises a structure configured to carry the portable surface treatment tool on the suction controller. A user can therefore simply manoeuvre the suction controller when moving from one surface to be treated to another, only removing the portable surface treatment tool when required.

In a further aspect, a kit of parts for providing a surface treatment system is provided, the kit comprising a portable surface treatment tool as disclosed herein.

Optionally the kit further comprises a suction hose configured to couple the suction connection formation of the portable surface treatment tool to a suction controller to remove fluid from the suction region of the tool when in use.

Optionally the kit further comprising a power supply configured to power the motor to drive the rotatable surface treatment unit.

Optionally the portable surface treatment tool comprises a fluid applicator configured to be mounted on the head of the tool and configured to apply fluid to a surface to be treated in use, and optionally wherein the kit further comprises a fluid reservoir configured to be coupled to the fluid applicator.

Optionally the kit comprises a pump configured to couple the fluid reservoir to the fluid applicator.

Optionally the power supply and/or the fluid reservoir and/or the pump is configured to be wearable by a user.

Optionally the kit further comprises a suction controller configured to be coupled to the suction connection formation of the portable surface treatment tool to remove fluid from the suction region of the tool when in use.

Optionally the suction controller is configured to be wearable by a user.

Optionally the kit further comprises at least one clasp configured for attachment to a suction controller, wherein the clasp is arranged to retain the portable surface treatment tool.

In a further aspect a shroud is provided for a portable surface treatment tool comprising a rotatable surface treatment unit, wherein the shroud is configured for attachment to a portable surface treatment tool, the shroud defining a suction region wherein the suction region is configured to suck fluid from a surface to be treated, and wherein the shroud defines a suction connection formation configured to be coupled to a source of suction supplied by a suction controller, the suction connection formation being in fluid communication with the suction region to remove fluid from a surface to be treated.

BRIEF DESCRIPTION OF FIGURES

Embodiments will now be described with reference to the accompanying drawings, in which.

DETAILED DESCRIPTION

Figure 1:
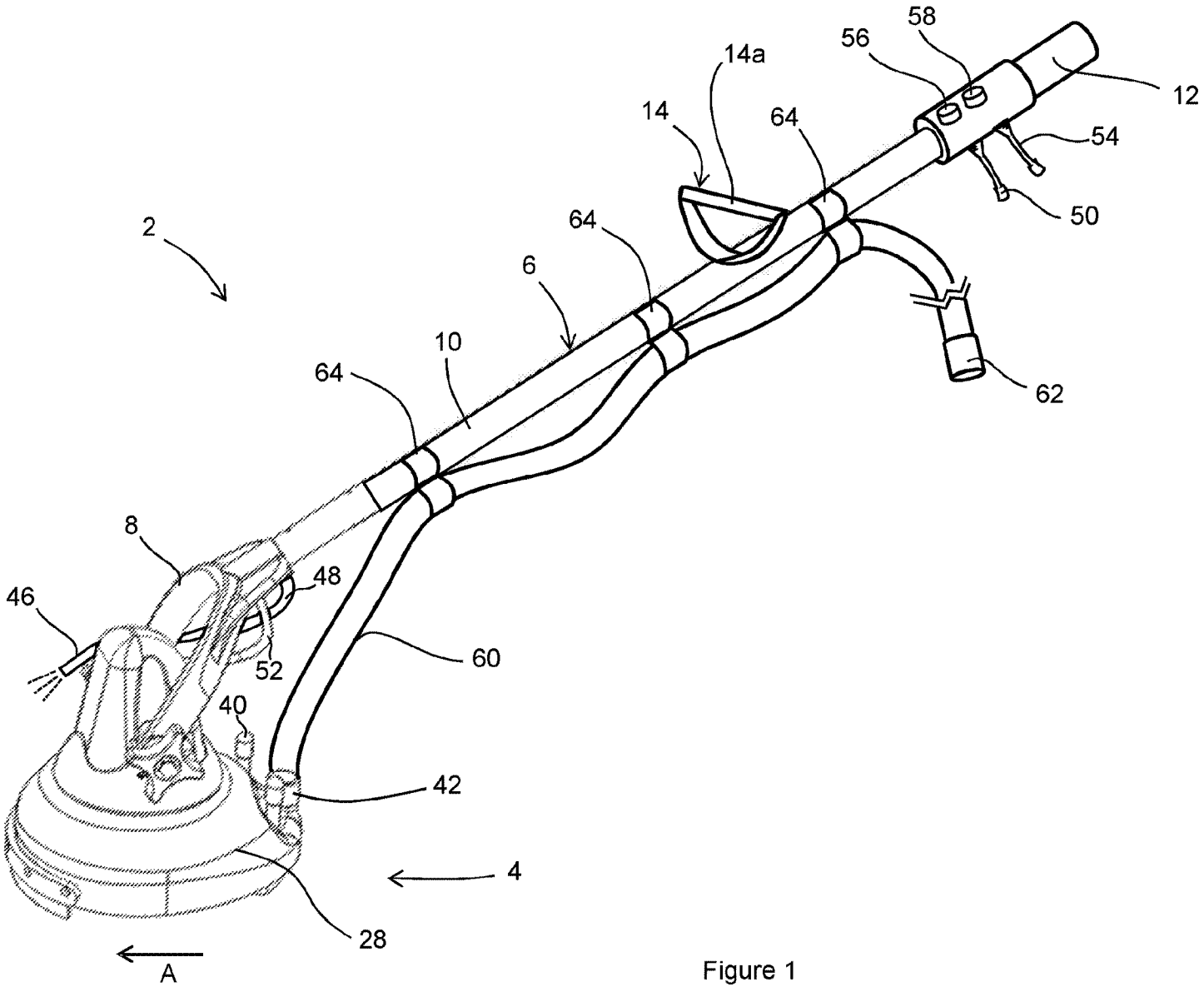
FIG. 1 shows a schematic perspective view of a portable surface treatment tool in accordance with an embodiment of the disclosure.

With reference to FIG. 1, a portable surface treatment tool generally indicated by the reference numeral 2 is provided. The portable surface treatment tool 2 has a head 4 and an elongate handle 6 coupled to the head 4 at one end via a bracket 8.

The elongate handle 6 comprises an elongate shaft 10 having a first end and a second end. The elongate shaft 10 is connected to the bracket 8 at the first end and extends to a grip 12, for example a foam grip, at the second end. An additional handgrip 14 is provided on the elongate shaft 10 and includes a grip region 14*a* for a user to hold. The grip region 14*a* extends substantially perpendicular to the length of the elongate shaft 10. The handgrip 14 is positioned at a convenient location along the length of the shaft 10 so that a user can easily manipulate the portable surface treatment tool 2 by holding the foam grip 12 in one hand and the grip region 14*a* of the handgrip 14 in the other. The portable surface treatment tool 2 is sufficiently lightweight and compact such that a user can manipulate the tool 2 such that the head 4 can be applied to vertical, overhead or inclined surfaces, as well as horizontal surfaces.

Figure 2:
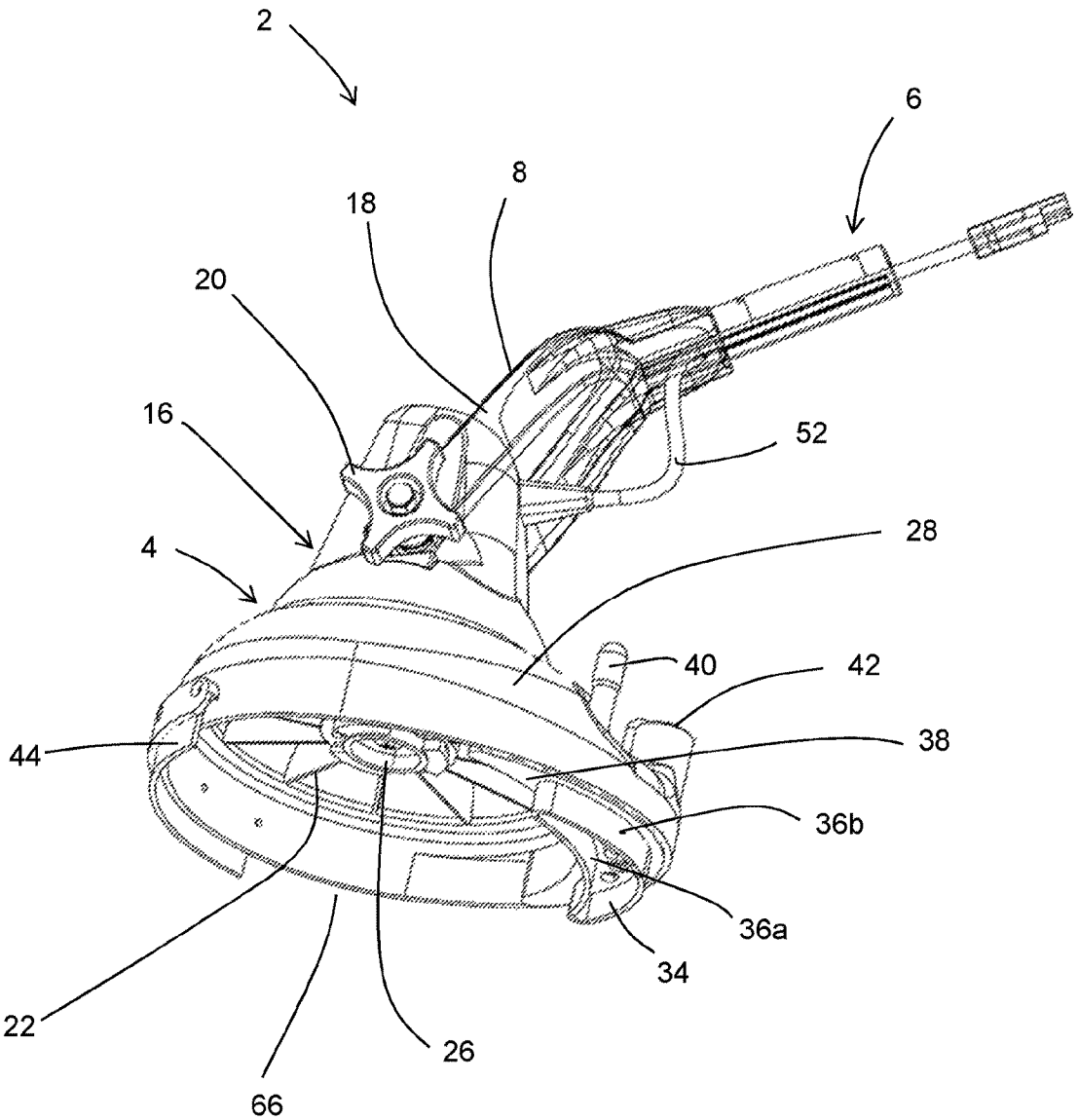
FIG. 2 shows a close-up perspective view of the head of the tool shown in FIG. 1.

Referring to FIG. 2, the head 4 of the tool 2 is shown. The tool head 4 includes a housing 16. The bracket 8 of the handle 6 is formed in a horseshoe shape such that each arm 18 of the bracket 8 is attached to either side of the housing 16 by a thumbscrew 20. By loosening and tightening the thumbscrews 20 the orientation of the head 4 with respect to the handle 6 can be adjusted as required.

The tool head 4 includes a motor (not shown) located within the housing 16 and a rotatable treatment unit 22. The rotatable treatment unit 22 is coupled to a motor shaft 24 via screw 26 (see FIGS. 3 and 4). The motor is arranged such that, when in use, the motor drives rotation of the rotatable treatment unit 22. The rotatable treatment unit 22 includes treatment material 22*a* (see FIG. 8*a*), for example, sponges, brushes, foam or other suitable material. For example, in some embodiments, the rotatable treatment unit 22 includes cleaning brushes. The rotatable treatment unit 22 is substantially circular and is configured for rotation about an axis substantially perpendicular to the surface to be treated when in use.

The housing 16 of the tool head 4 includes a shroud 28 and an upper housing portion 32, wherein the handle 6 is attached to the tool head 4 at the upper housing portion 32. The shroud 28 is arranged to encase at least a portion of the rotatable treatment unit 22. In some embodiments, the shroud 28 is removably attached to the upper housing portion 32. In some embodiments, to attach the shroud to the upper housing portion 32, the rotatable treatment unit 22 is first removed from the tool head 4 by undoing the screw 26 that fixes the rotatable treatment unit 22 to the motor shaft 24. When the rotatable treatment unit 22 is removed, the shroud 28 can be positioned over the motor shaft 24 such that an upper surface 28*a* of the shroud is arranged adjacent the upper housing portion 32. The upper surface 28*a* of the shroud 28 is provided with a series of holes 30 corresponding to a series of holes on the upper housing portion 32 (not shown). The shroud 28 can therefore be fixed in place via screws passing through the corresponding holes of the shroud 28 and upper housing portion 32. Once the shroud 28 is in place, the rotatable treatment unit 22 is then reattached to the motor shaft 24 so that the tool head 4 is ready for use. In this way a tool, such as the DC power scrubber disclosed in U.S. Pat. No. 5,289,605, can be adapted to include a shroud 28 as disclosed herein. The disclosure of U.S. Pat. No. 5,289,605 is incorporated herein by reference.

The shroud 28 includes a perimeter edge provided adjacent the surface to be treated when in use. In other words the perimeter edge of the shroud 28 is provided distal the upper surface 28*a* of the shroud. The shroud 28 includes a suction region 34 arranged to extend around a portion of the perimeter edge of the shroud 28 such that the suction region 34 is adjacent a surface to be treated when in use.

The suction region 34 is defined by resilient guide members 36*a*, 36*b*. The resilient guide members 36*a*, 36*b* can be formed as rubber blades, for example squeegees. The resilient guide members 36*a*, 36*b* are carried by a mounting unit 38 which is removably mounted on the shroud 28 and held in place via thumbscrews 40. In this way, the resilient members 36*a*, 36*b* can be replaced when worn or otherwise necessary without the need to replace the entire shroud 28. A portion of the resilient guide members 36*a* proximal the rotatable treatment unit 22 is provided with openings 37 along an edge of the resilient guide member 36*a* wherein, when in use, the edge having the openings 37 is arranged to be positioned adjacent the surface to be treated such that fluid on the surface can pass through the openings 37. The openings 37 are illustrated on FIG. 5*b*. The openings 37 are not illustrated on the remaining Figures for the sake of clarity.

The resilient guide members 36*a*, 36*b* extend around a portion of the perimeter of the shroud 28 such that the resilient members 36*a*, 36*b* are curved in shape. The suction region can be thought of as being defined by two curved resilient guide members 36*a*, 36*b* which are coupled to each other at either end. One resilient guide member 36*a* is provided proximal the rotatable unit 22 and one resilient guide member 36*b* is provided distal the rotatable unit 22. The angle of curvature of the distal resilient member 36*b* is greater than the angle of curvature of the proximal resilient member 36*a* to define the suction region. In the embodiment illustrated in FIGS. 1 to 5*b*, the chords formed by arcs defined by the proximal and distal resilient members 36*a*, 36*b* are substantially equal and are less than the diameter of the rotatable unit 22.

In other embodiments the chords formed by the arcs defined by the proximal and distal resilient members 36*a*, 36*b* are not equal. In some embodiments, the chord formed by the arc defined by the proximal and/or distal resilient guide member 36*a*, 36*b* is greater than the diameter of the rotatable unit 22. In this way improved guiding of fluid left behind by the rotatable unit 22 when in use is achieved.

The shroud 28 also defines a suction connection formation 42 which is in fluid communication with the suction region 34. The suction connection formation 42 is a substantially cylindrical extension which is shaped to engage a suction hose 60 which can in turn be coupled to a suction source. In some embodiments, the suction hose 60 engages the suction connection formation 42 by virtue of a push-fit or friction engagement. In other embodiments alternative engagement means may be used, for example a snap-fit or bayonet fitting.

As described above, the suction region 34 is provided such that it extends around a portion of the perimeter of the shroud 28. An additional resilient guide member 44 is provided extending around a portion of the perimeter of the shroud 28 substantially opposite the suction region 34. In this way, gaps 66 are provided between the resilient members 36*a*, 36*b* defining the suction region 34 and the additional resilient member 44. In some embodiments, this additional resilient guide member 44 is a rubber blade, for example a squeegee.

The additional resilient guide member 44 is arranged to extend in a direction away from the shroud, i.e. towards the surface to be treated when in use. Similarly the resilient guide members 36*a*, 36*b* defining the suction region 34 extend in a direction away from the shroud 28, i.e. towards the surface to be treated when in use. In the embodiment illustrated in FIGS. 1 to 5*b*, the resilient guide members 36*a*, 36*b* defining the suction region 34 extend away from the shroud by a greater distance than the additional resilient guide member 44. For example, the resilient guide members 36*a*, 36*b* defining the suction region 34 extend away from the shroud by up to 10 mm more than the additional resilient guide member 44, for example up to 9, 8, 7, 6, 5, or 4 mm more, for example by up to 3 mm more, for example by up to 2 mm more, for example by up to 1 mm more. In some embodiments the resilient guide members 36*a*, 36*b* defining the suction region 34 extend away from the shroud by about 2 mm more than the additional resilient guide member 44.

The additional resilient guide member 44 extends around the perimeter of the shroud to form an arc. In the embodiment illustrated in FIGS. 1 to 5*b*, the chord formed by the arc defined by the additional resilient guide member 44 is less than the diameter of the rotatable unit 22. In other embodiments the chord formed by the arcs defined by the additional resilient guide member 44 is greater than the diameter of the rotatable unit 22. In this way improved guiding of fluid towards the rotatable unit 22 when in use can be achieved.

In some embodiments, the resilient guide members 36*a*, 36*b* defining the suction region 34 are spring mounted on the shroud 28. In some embodiments, the additional resilient guide member 44 is spring mounted on the shroud 28. This is beneficial since the position of the resilient guide members 36*a*, 36*b* and/or the additional resilient guide member 44 can adjust in response to variation in the depth of the treatment material 22*a* of the rotatable treatment unit 22, for example, sponges, brushes, foam or other suitable material. In this way, the portable surface treatment tool is suitable for use with a range of rotatable surface treatment units 22, without requiring adjustment of the position of the resilient guide members 36*a*, 36*b* and/or the additional resilient guide member 44.

As can be seen from FIG. 1, the tool head 4 includes a fluid applicator 46 configured to apply fluid, for example treatment or cleaning fluid or liquid, to a surface to be treated. The fluid applicator 46 is mounted on the housing 16 of the tool head 4 and is coupled to a fluid pipe 48 which extends through the elongate shaft 10 of the handle 6. In other words, the fluid pipe 48 extends through a hollow interior of the elongate shaft 10. The fluid pipe 48 terminates proximal the foam grip 12 at a connector 50 configured to connect to an external fluid reservoir. In some embodiments, the fluid pipe 48 is a 4 mm nylon coiled hose. The fluid applicator 46 is configured to couple to the fluid pipe 48. In some embodiments, the fluid applicator 46 or the fluid pipe 48 includes a check valve (not shown) to prevent fluid dripping from the fluid applicator 46 when not desired.

Figure 5A:
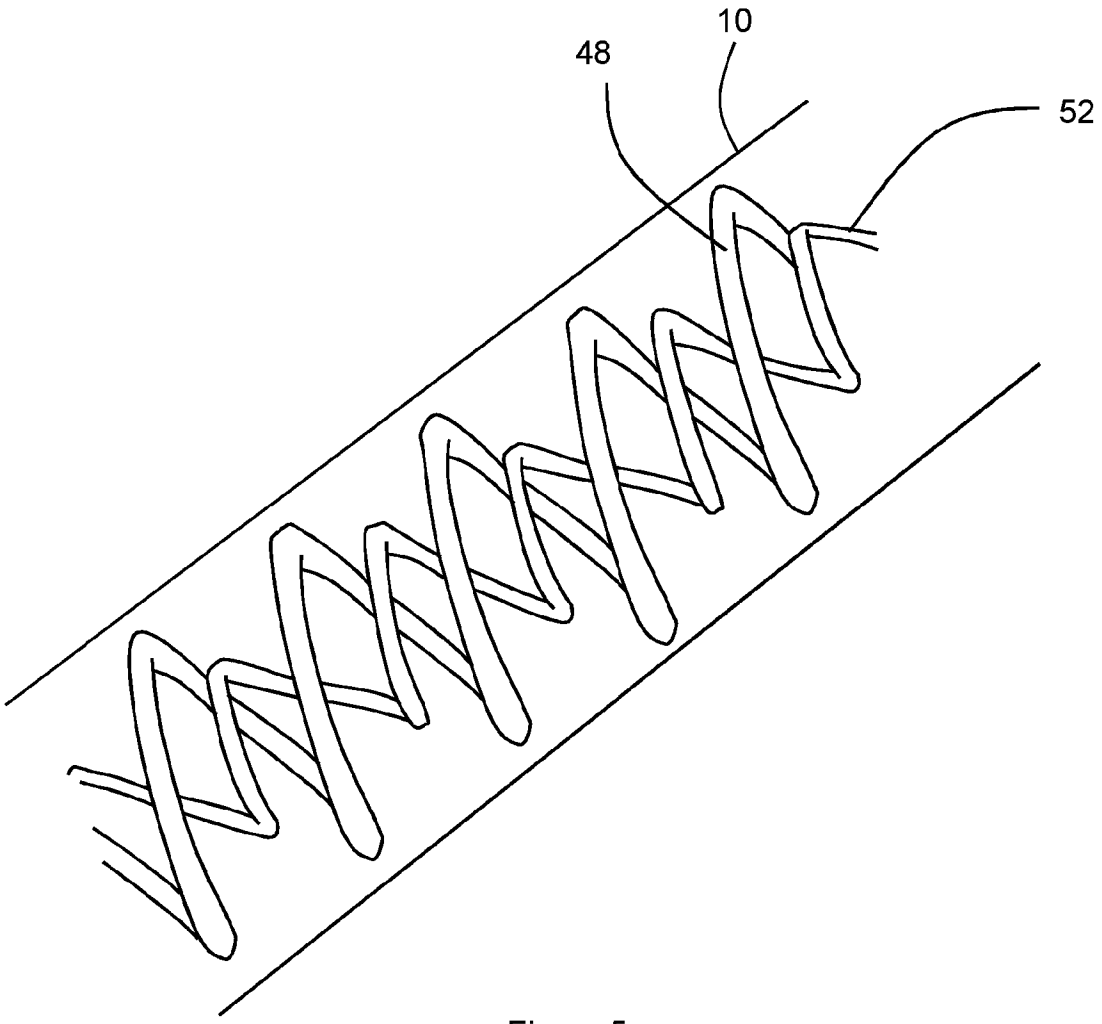
FIG. 5*a* shows a cut-away view through the handle of the tool shown in FIG. 1.
Figure 5B:
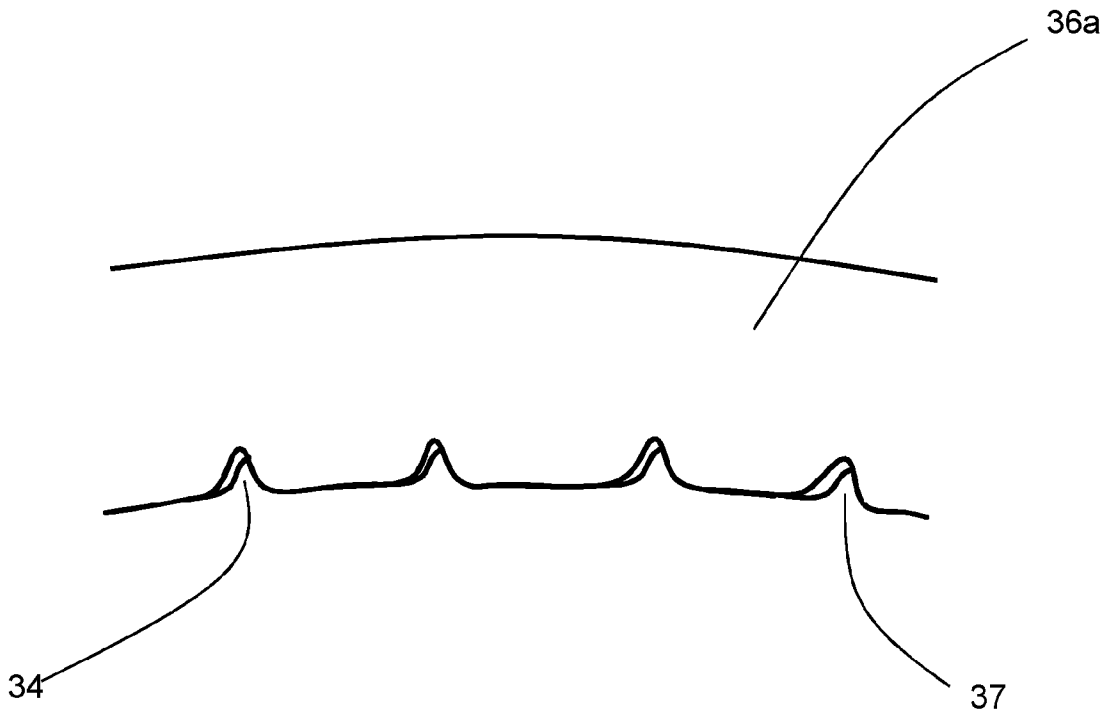
FIG. 5*b* shows a close up view of a resilient guide member of the tool of FIG. 1.

Also as can be seen from FIG. 1, power cable 52 is provided and is configured to transmit power to the motor from an external power source. The power cable 52 extends from the housing 16 of the tool head and extends through the elongate shaft 10 of the handle 6. In other words, the power cable 52 extends through a hollow interior of the elongate shaft 10. The power cable 52 terminates proximal the foam grip 12 and is coupled to a connector 54 configured to couple to an external power source. In some embodiments, the power cable 52 is a coiled cable and is arranged to extend down the shaft 10 of the handle 6 such that is passes within the hollow defined by the coiled fluid pipe, as can be seen in FIG. 5*a*.

A pair of actuators 56, 58, e.g. press buttons, are provided proximal the foam grip 12 and are configured such that the first actuator 56 is a rotatable treatment unit actuator which causes rotation of the rotatable treatment unit 22 when activated. The second actuator 58 is a fluid actuator which causes application of fluid from the fluid applicator 46 when actuated. The actuators 56, 58 are configured to receive power required for operation of the actuators 56, 58 from an external power source when it is coupled to the tool 2 via the power connector 54.

In use the portable surface treatment tool 2 is connected to an external power supply via connector 54. In this way power is provided to the motor to drive the rotatable treatment unit 22 which, for example, is provided with brushes. The external power supply also provides power to the actuators 56, 58 for operation. The external power may be provided by a battery. In some embodiments, the battery is configured to be wearable by a user, for example in a backpack, on a belt, or by other suitable means. In some embodiments, the power connector 54 is coupled to the power supply of another surface treatment machine, for example a separate scrubber dryer, wet vacuum, steam cleaner, or other suitable surface treatment machine. In such embodiments, the user is not required to carry a battery pack to operate the tool.

The portable surface treatment tool 2 is connected to an external fluid supply via connector 50. In this way fluid can be provided to the fluid applicator 46 when required. The external fluid supply, in some embodiments, is a fluid reservoir, for example a container which can hold a treatment fluid. The fluid connector 50 is coupled to the external fluid supply via a pump which is configured to pump fluid down the fluid pipe 48 to the fluid applicator 46. For example, the pump may be a 5 litre/116 PSI (5 litre/799792 Pa) self-priming diaphragm pump. The pump can be powered by the same external power supply that powers the tool. In some embodiments, the fluid reservoir and pump are configured to be wearable by a user, for example in a backpack, on a belt, or by other suitable means. In other embodiments, the fluid connector is coupled to the fluid reservoir of another surface treatment machine, for example a separate scrubber dryer, wet vacuum, steam cleaner, or other suitable surface treatment machine. Large scrubber dryers do not typically include a fluid pump since fluid application to the surface to be treated is gravity fed. However, a pump for operation of the portable surface treatment tool can be housed in such a machine.

The portable surface treatment tool 2 is connected to an external source of suction supplied by a suction controller, for example provided by a separate scrubber dryer machine, wet vacuum, steam cleaner, other suitable surface treatment machine, or other vacuum unit, for example a vacuum unit configured to be wearable by a user. A suction hose 60 is connected to the suction connection formation 42 defined by the shroud 28 of the tool head 4, for example by push fit engagement. The suction hose 60 has at its other end a connector 62 which is arranged to be coupled to the source of suction provided by the suction controller. In some embodiments, the tool 2 is coupled to the source of suction by between 4 and 10 m of suction hose, for example between 6 and 8 m, for example 8 m. It will be appreciated that any desirable length of hose may be used. The tool 2 can be coupled to the source of suction via a single length of suction hose or by multiple lengths of suction hose coupled together.

In some embodiments, the suction controller is a separate surface treatment machine having a source of suction. The suction hose 60 is, in some embodiments, coupled to the separate surface treatment machine via a tap which can be manipulated by a user to switch the suction between the portable surface treatment tool 2 and the separate surface cleaning machine.

As can be seen in FIG. 1, the suction hose 60 is connected to the handle 6 of the tool 2 via a series of connectors 64. This acts to keep the suction hose 60 in a convenient position such that it does not interfere with the operation of the tool 2. In other embodiments, the suction hose is connected to the suction connection formation 42 and then extends through the shaft 10 of the handle 6. In other words, suction hose 60 extends through a hollow interior of the elongate shaft 10. In some embodiments, the fluid pipe 48 and power cable 52 extend through the hollow interior of the suction hose 60. This provides a neat arrangement that does not interfere with the operation of the tool 2. Alternatively, the fluid pipe 48 and power cable 52 may be carried by the exterior of the suction hose 60. In some embodiments the fluid pipe 48, power cable 52 and suction hose 60 are formed as an integral component.

The portable surface treatment tool 2 is manoeuvred by a user holding the grip region 14*a* with one hand and the foam grip 12 with the other. Due to the compact and lightweight nature of the tool 2, the user can manoeuvre the tool to treat surfaces which are overhead, inclined, vertical, or horizontal as well as difficult to reach areas, for example stairs, washroom facilities and other such locations.

By pressing the fluid actuator 58, the pump is caused to suck fluid from the fluid reservoir. The fluid is then pumped down the fluid pipe 48 to the fluid applicator 46, from which the fluid is sprayed or otherwise applied to the surface to be treated. As can be seen from FIG. 1, fluid is applied to the region of the surface ahead of the tool when the tool is moved in direction A. In other words, the region of the surface adjacent the additional resilient guide member 44. In other embodiments, the fluid applicator is arranged to apply fluid to the region of the surface to the rear of the tool, in other words, the region of the surface adjacent the suction region 34.

By pressing the rotatable treatment unit actuator 56, the rotatable treatment unit and treatment material, for example brushes, carried thereon, are caused to rotate. By moving the tool in direction A as indicated in FIG. 1, the rotating brushes are moved over the surface and over the fluid applied thereto in order to clean the surface.

As the tool is continued to be moved in direction A, the fluid used by the brushes to clean the surface enters the suction region 34 via the openings 37 in the resilient member 36*a* proximal the rotating brushes. The resilient members 36*a*, 36*b* are shaped to guide fluid towards the suction region 34. From the suction region 34, fluid is sucked from the surface and travels along the suction hose 60, for example to a used fluid reservoir. In some embodiments, the removed fluid is passed to a used fluid reservoir of a larger scrubber dryer machine.

In this way, cleaning and drying of the surface are both carried out in the region defined by the shroud 28 to provide compact and effective surface treatment.

To facilitate removal of fluid from the surface, the user can tip the tool 2 such that the additional resilient member 44 is brought into contact with the surface. By then drawing the tool towards the user, in other words in the direction substantially opposite the direction indicated by A, the additional resilient member 44 scrapes across the surface, collecting fluid as is it does so. The tool can then be moved back over the collected fluid such that the fluid enters the suction region 34 and is removed from the surface. In other words, the additional resilient guide member 44 is arranged to draw fluid from tight, difficult to access areas, into an area in which it can be removed by the suction region 34 of the tool. This functionality is particularly useful to remove water from the edges of a floor adjacent a wall, stairs or other areas where access and tool manoeuvrability is limited.

Figure 3:
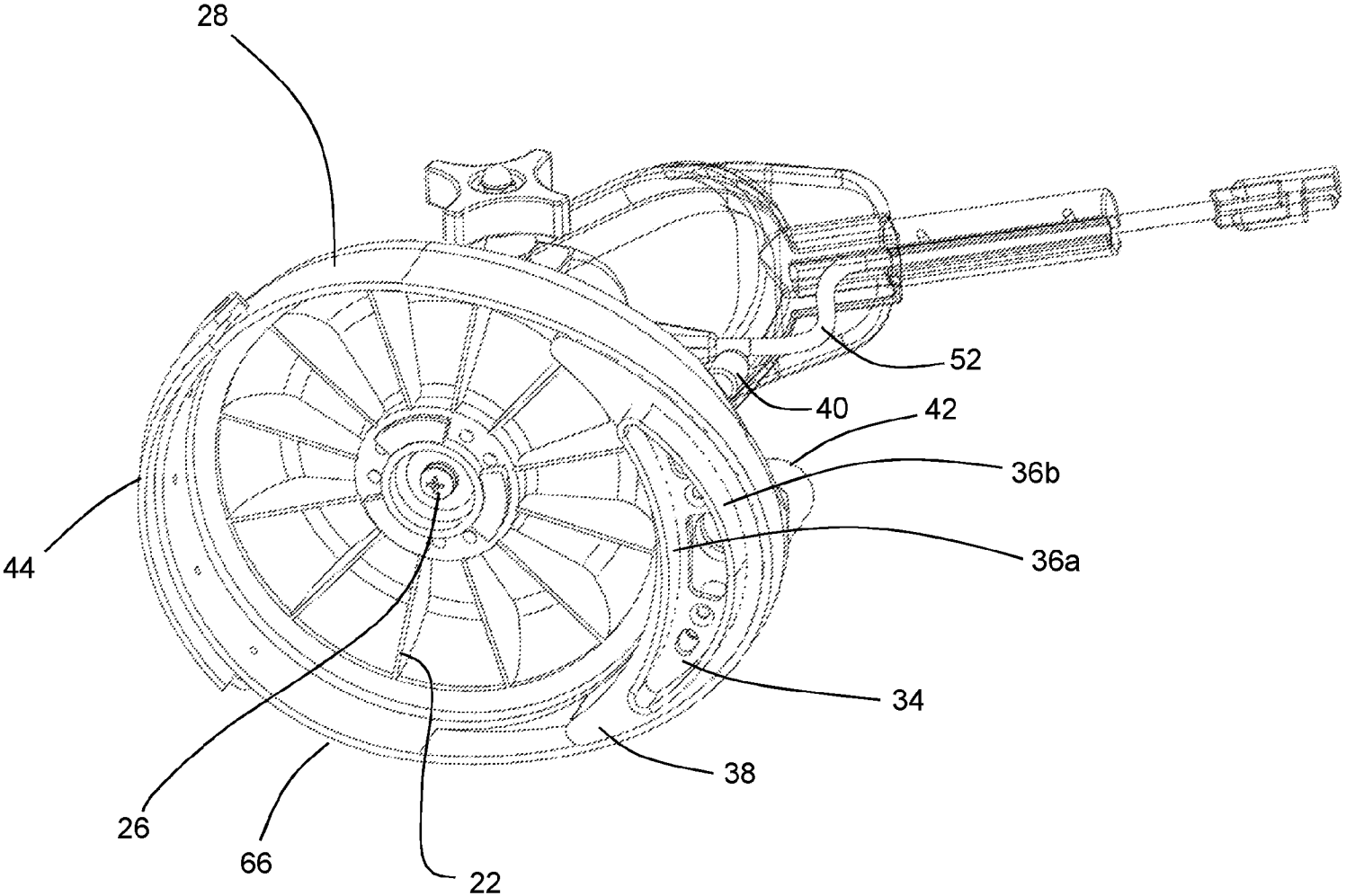
FIG. 3 shows a close-up perspective view of the underside of the head of the tool shown in FIG. 1.
Figure 4:
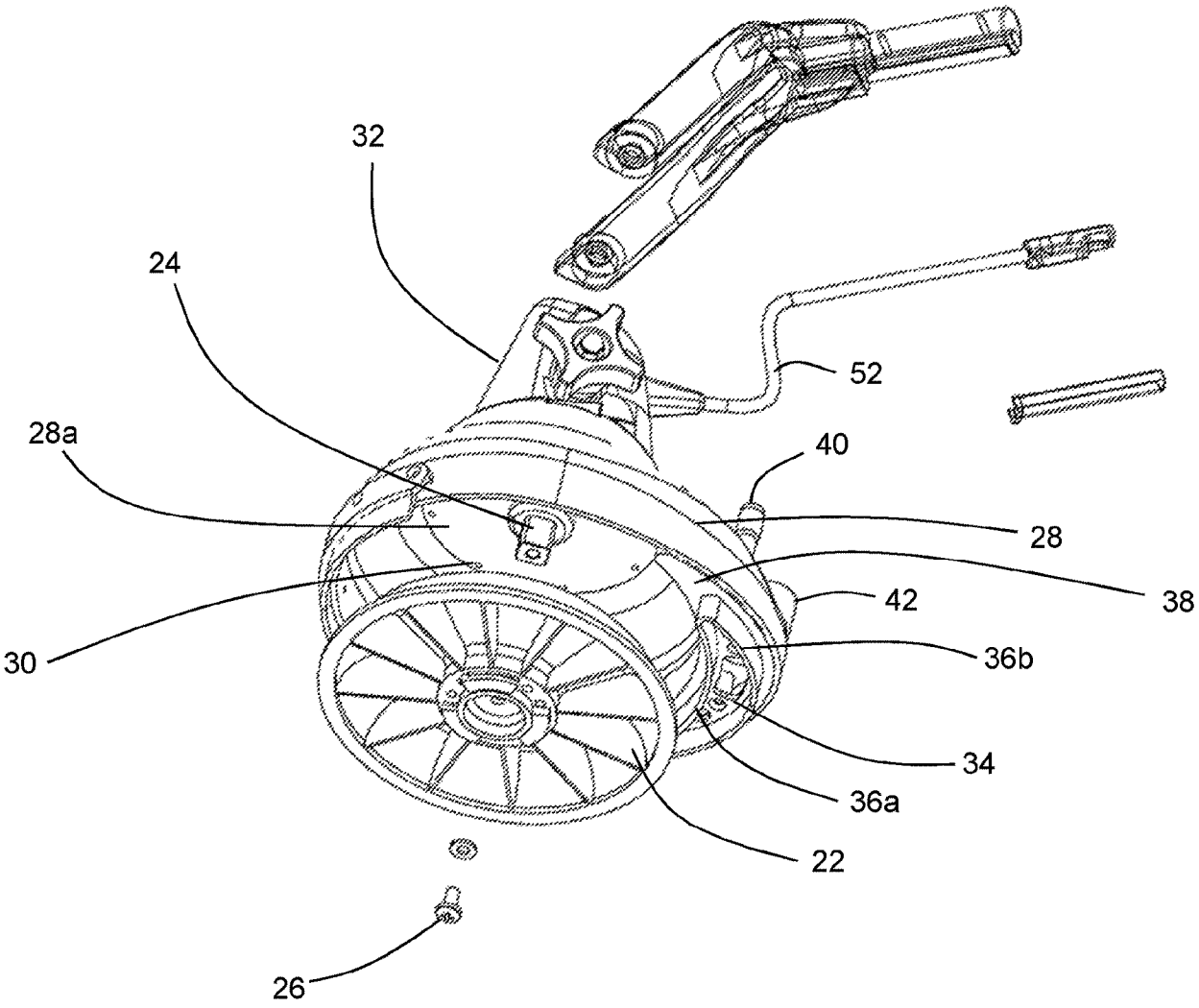
FIG. 4 shows an exploded view of the head of the tool shown in FIG. 1.

In addition, as can be seen in particular from FIGS. 2 and 3, since gaps 66 are provided between the resilient member 36*a*, 36*b* defining the suction region 34 and the resilient member 44 provided opposite the suction region 34, the rotatable treatment unit, for example brushes mounted thereon, can be brought closer to a surface to be treated, for example edges between a floor and a wall or other obstacle. In this way improved surface treatment can be achieved.

With reference to the embodiment illustrated in FIGS. 6 to 8*c*, in some embodiments, the portable surface treatment tool 2 is attached to a separate scrubber dryer 68 for use. The scrubber dryer 68 is provided with tool retaining clasps 70 arranged retain the portable surface treatment tool 2 on the scrubber dryer 68 such that the tool 2 can be stored on the scrubber dryer 68 and removed when required. In such embodiments, power, fluid and suction are all provided by the scrubber dryer 68. The portable surface treatment tool 2 is the same as that described in relation to FIGS. 1 to 5*b*, however a power cable 52 and fluid pipe 48 are arranged to extend down the suction hose 60, connecting to the tool 2 proximal the tool head 4. In this embodiment, connectors 50 and 54 are not provided since the power and fluid lines are connected to the tool 2 proximal the tool head 4. The suction hose 60 is coupled to the suction connection formation 42 and is connected to the handle 6 by connectors 64 as previously described. Alternatively, the suction hose 60 extends through the shaft 10 of the handle 6.

The portable surface treatment tool 2 is configured for attachment to a scrubber dryer 68 capable of treating large areas of floor without requiring recharging of a battery or refilling of a fluid tank, for example areas between 4000 $m^2$ and 14000 $m^2$. Such scrubber dryers 68 typically comprise two wheels joined together by an axle and a handle 71 by which a user may push and steer the scrubber dryer 68. Large scrubber dryers 68 typically weigh between 50 and 2000 kg, for example between 200 and 550 kg. Large scrubber dryers may be ride-on machines, i.e. where a user rides on the machine, or walk-behind machines i.e. where a user walks behind the machine. Some large scrubber dryers are self-propelled, some must be pushed by a user and some are operated by a combination of self-propulsion and user-propulsion.

Figure 6:
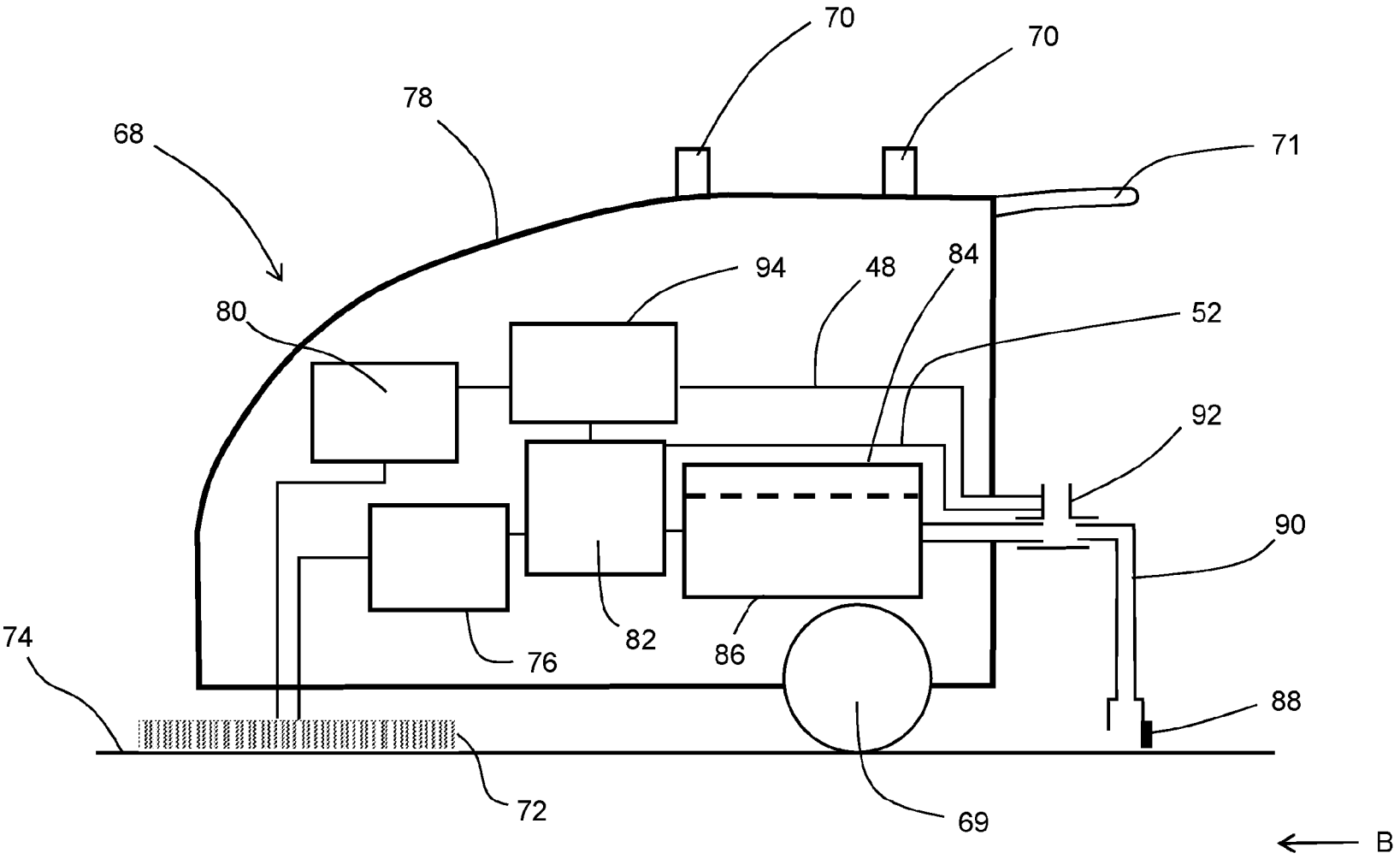
FIG. 6 shows a schematic illustration of a suction controller of a surface treatment system in accordance with an embodiment of the disclosure.

As illustrated by the schematic diagram shown in FIG. 6, as with a typical scrubber dryer, the scrubber dryer 68 includes a pair of rotary brushes 72 configured to engage a surface 74 to be treated. The rotary brushes 72 is configured to rotate about axes substantially perpendicular to the surface 74 to be treated. The rotation of the rotary brushes 72 is driven by a motor 76 which is provided within a housing 78 of the scrubber dryer 68. The motor 76 receives power from a power source 82, e.g. a battery, located in the housing 78. Large scrubber dryers 68 are typically arranged to have a working brush width of between 500 and 1000 mm.

Also provided in the housing of the scrubber dryer 68 is a fluid reservoir 80 configured to apply fluid, e.g. cleaning liquid, to the rotary brushes 72 for treating the surface 74. Fluid is applied to the rotary brushes 72 from the fluid reservoir by means of a gravity fed system as will be understood by those skilled in the art. Large scrubber dryers 68 typically have a fluid reservoir 80 capable of holding between 20 and 500 litres, for example between 40 and 100 litres.

The scrubber dryer 68 includes a resilient blade 88 arranged to trail behind the scrubber dryer 68 when travelling in direction B, such that fluid from the surface 74 is collected by the resilient blade 88. A suction hose 90 is coupled to a source of suction 84, e.g. a vacuum unit, within a collection tank 86 provided in the housing of the scrubber dryer 68, and the suction hose 90 is arranged to remove the fluid collected by the resilient blade 88 from the surface 74. Large scrubber dryers 68 are typically arranged to have resilient blade width of between 500 and 1300 mm, for example between 800 and 1300 mm.

Figure 8A:
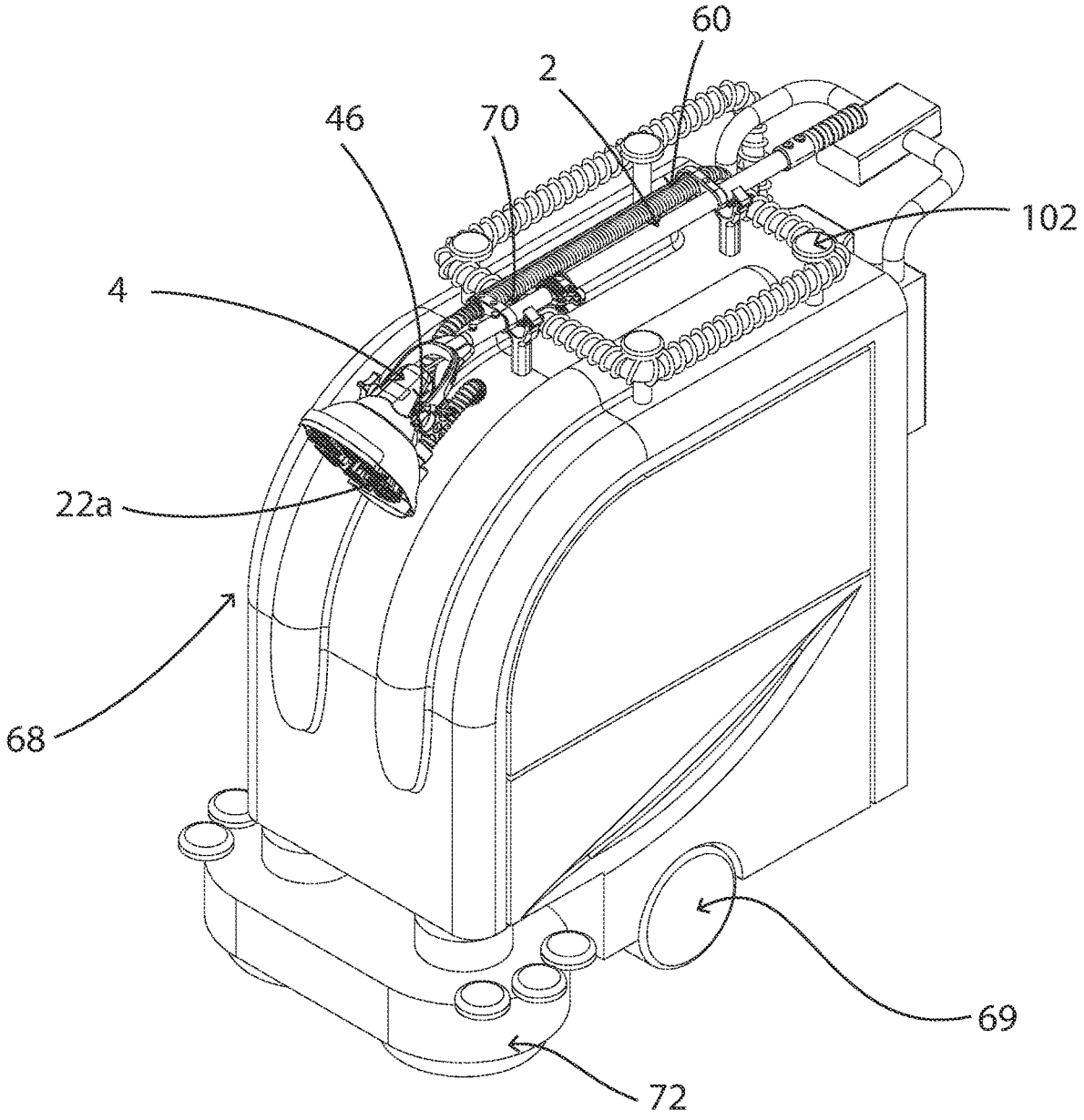
FIG. 8*a* shows a portable surface treatment tool attached to the suction controller of FIG. 6.

The scrubber dryer 68 includes a series of projections 102 (as shown in FIG. 8*a*), for example four projections, extending from the housing 78. The projections 102 are arranged such that the suction hose 60 of the tool 2 can be wrapped around the projections 102 when the tool 2 is stored on the scrubber dryer 68, thereby keeping the suction hose 60 neatly out of the way when the tool 2 is not in use.

Figure 7:
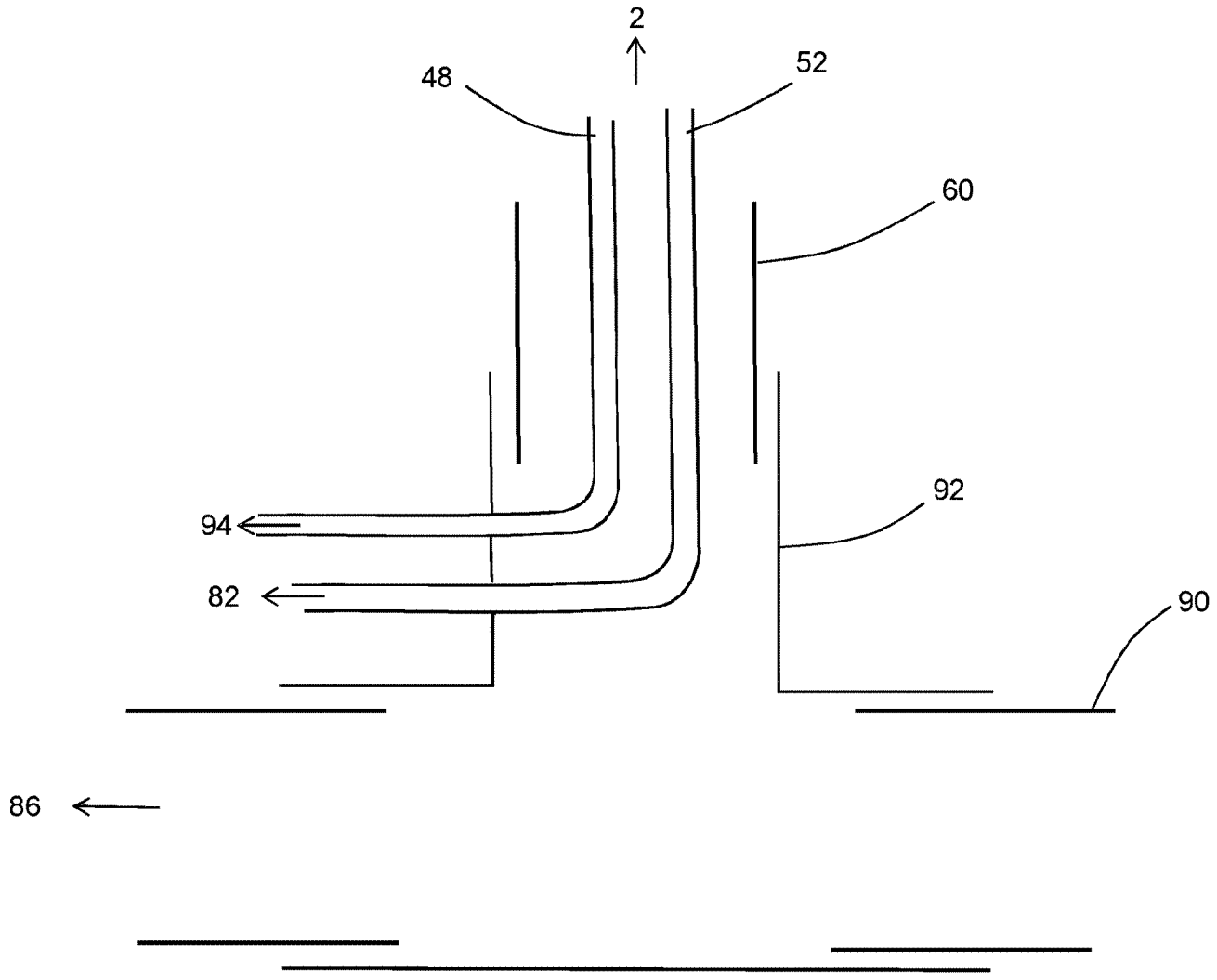
FIG. 7 shows a schematic illustration of a connector arranged to couple a portable surface treatment tool to the suction controller shown in FIG. 6.
Figure 8B:
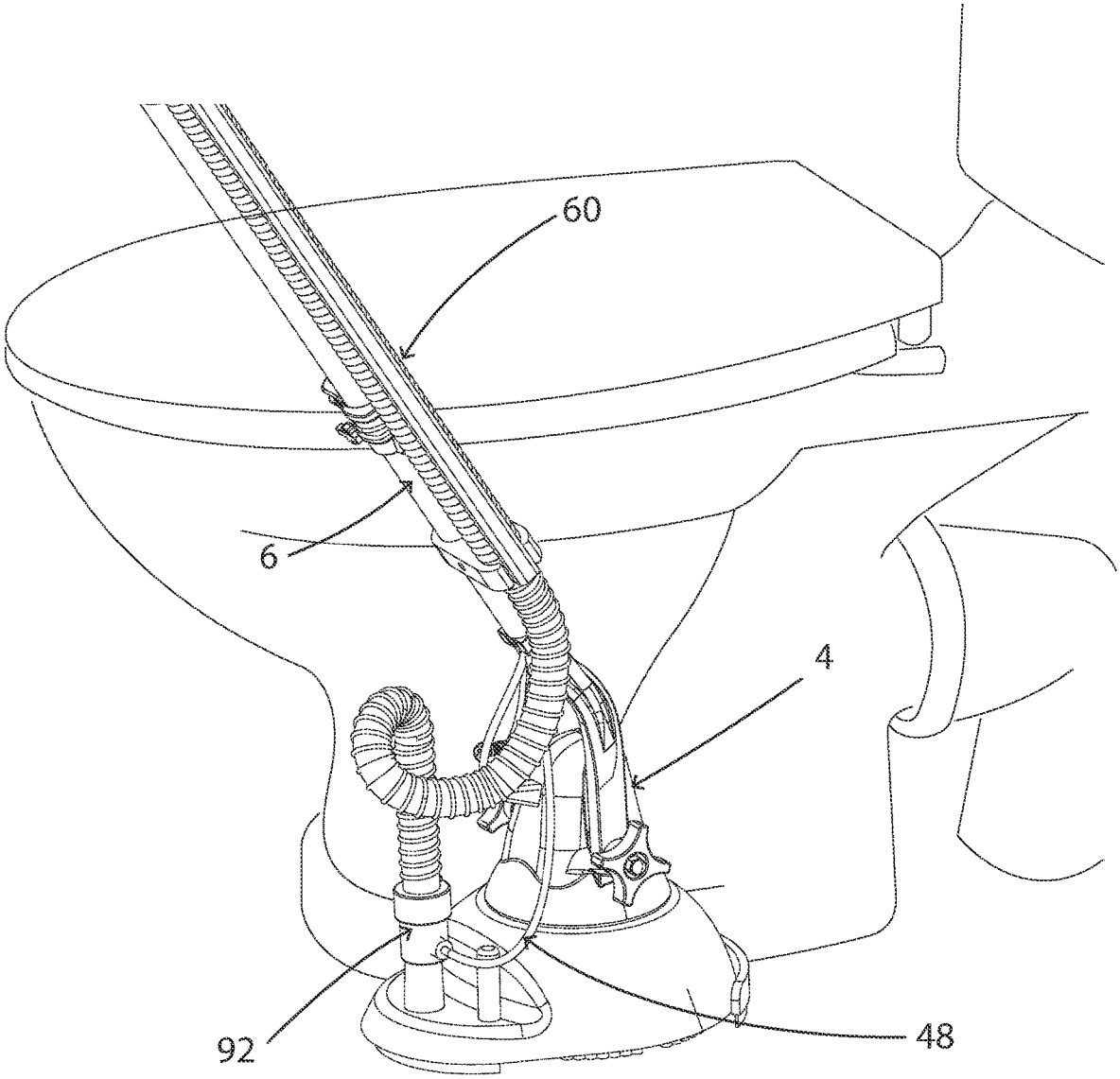
FIG. 8*b* shows a portable surface treatment tool in use.
Figure 8C:
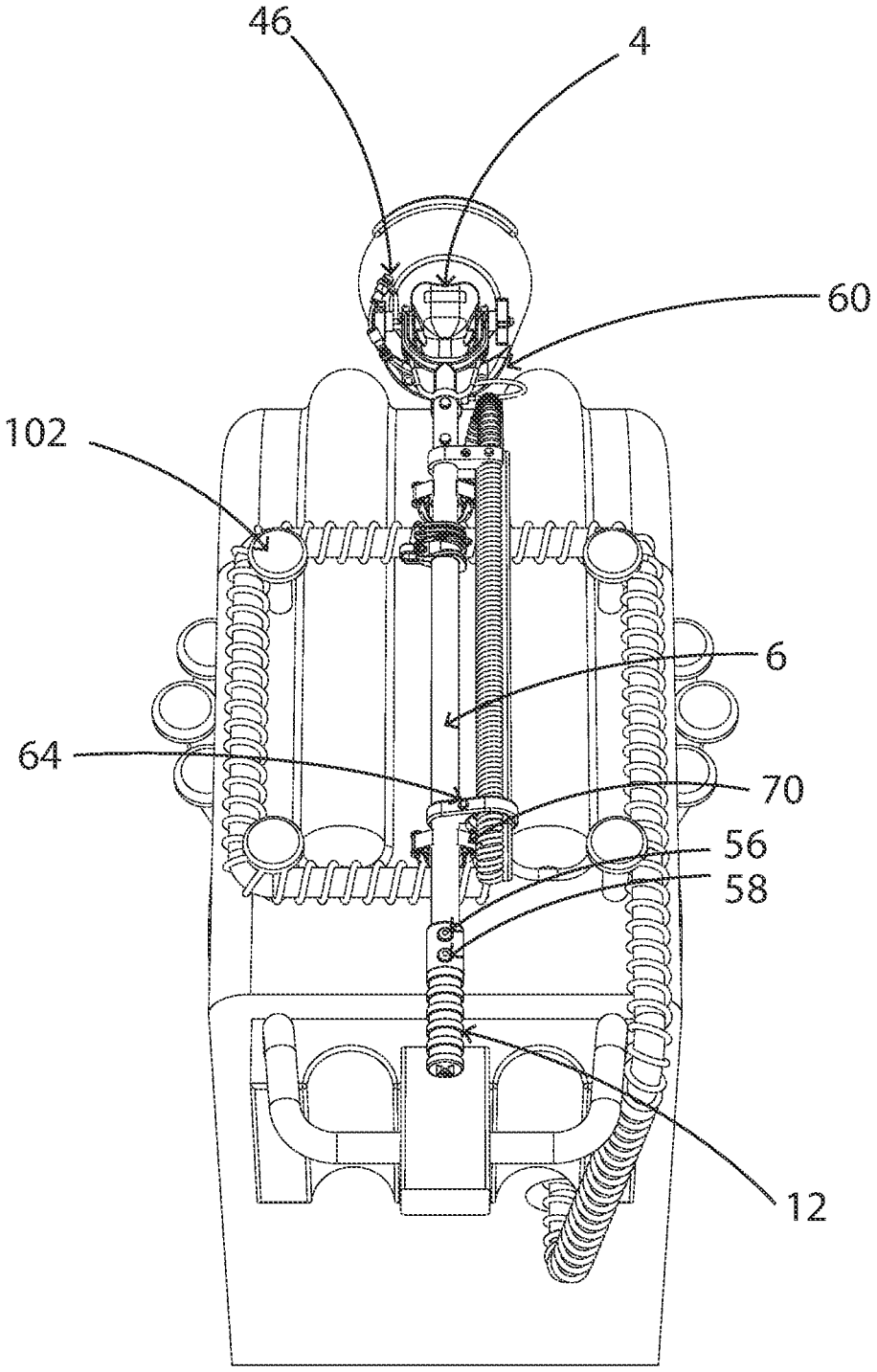
FIG. 8*c* shows a portable surface treatment tool attached to the suction controller of FIG. 6.

As illustrated in more detail in FIG. 7, the scrubber dryer 68 is connected to the portable surface treatment tool 2 via a connector 92. As described above, the power cable 52 and fluid pipe 48 are coupled to the tool 2 and arranged to pass through the inside of the suction hose 60, the suction hose also being connected to the tool 2. The suction hose 60 carrying the power cable 52 and fluid pipe 48 is attached to the scrubber dryer 68 by connector 92. At the connector 92, the suction hose 60 of the tool 2 is coupled to the suction hose 90 of the scrubber dryer 68. The fluid pipe 48 and power cable 52 of the tool 2 exit the suction hose 60 at the connector 92, the power cable 52 being coupled to the power source 82 and the fluid pipe 48 being coupled to the fluid reservoir 80. The suction hose 60 carrying the power cable 52 and fluid pipe 48 is coupled to the tool 2 via a similar connector as can be seen in FIG. 8*b*.

A fluid pump is required to pump fluid from the fluid reservoir 80 to the fluid applicator 46 of the tool 2, therefore a pump 94 is provided in the housing of the scrubber dryer 68 such that the fluid pipe 48 is coupled to the fluid reservoir 80 via the pump 94.

The suction hose 60 of the tool is coupled to the scrubber dryer 68 via a tap (not shown) which enables a user to switch the suction provided by the vacuum unit 84 between the scrubber dryer 68 and the tool 2. In an alternative embodiment, a third actuator, e.g. in the form of a button, is provided on the portable tool 2 which is configured to control the application of suction to the portable tool 2.

In an alternative embodiment the power cable 52 and fluid pipe 48 are coupled or clipped to an exterior of the suction hose 60. Alternatively, the suction hose 60, fluid pipe 48 and power cable 52 may be formed as a single component.

When in use, the operator can use the larger scrubber dryer 68 to treat large open surfaces suitable for treatment by a larger machine. When the operator reaches a smaller area to clean, or an area that is more difficult to access, the operator can remove the portable surface treatment tool 2 from the tool retaining clasps 70 of the scrubber dryer 68 and use this to effectively treat these smaller areas, as shown in FIG. 8*b*. The portable surface treatment tool 2 is used in the same manner as described above, the user switching the suction from the scrubber dryer 68 to the portable tool 2 as required. In this way, the operator does not require any additional equipment or machines to clean smaller, more difficult to access areas. Accordingly, the operator can complete treatment of the entire surface to be cleaned more efficiently and hence cost effectively.

Whilst the above embodiment has been described in relation to the portable surface treatment tool 2 being attached to a scrubber dryer 68, in alternative embodiments, the portable surface treatment tool 2 is attached to a wet vacuum, a steam cleaner or other suitable surface treatment equipment. In embodiments where a steam cleaner is used, the fluid applied by the fluid applicator of the tool 2 can be steam taken from the steam cleaner.

Figure 9:
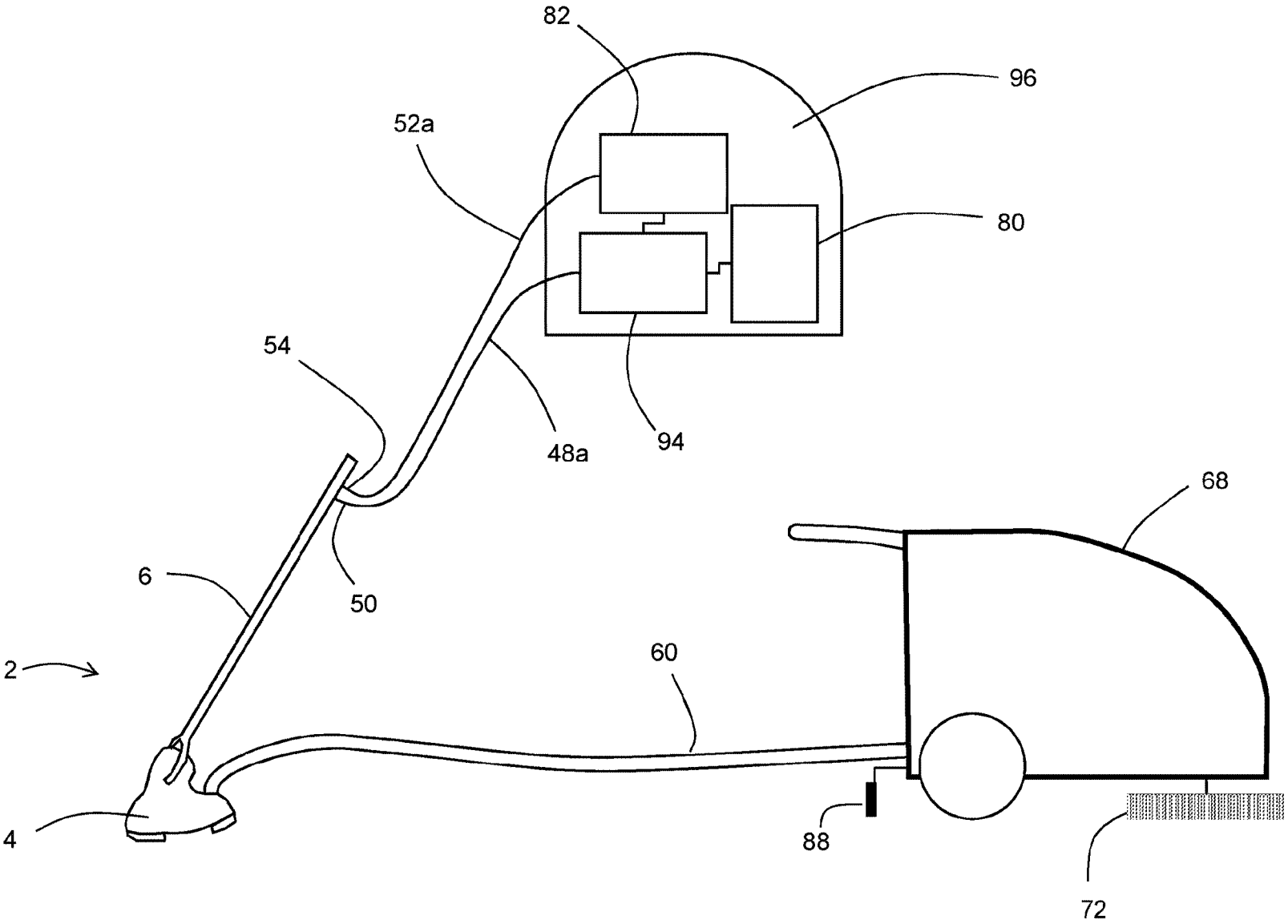
FIG. 9 shows a schematic illustration of a surface treatment system in accordance with another embodiment of the disclosure.

In a further embodiment the portable surface treatment tool 2 is configured for connecting to a power supply 82, pump 94, and fluid reservoir 80 carried by a back pack 96 which can be worn by a user. This is illustrated in FIG. 9. As can be seen in FIG. 9, the fluid reservoir 80 is coupled to the tool 2 via a pump 94, the fluid pipe 48 of the tool 2 being coupled to the pump 94 via the connector 54 and a fluid pipe 48*a* extending from the pump 94.

The power supply 82 provided by the backpack 96 is in the form of a battery which provides power to the tool 2 and also to the pump 94. The battery 82 is coupled to the tool 2 via the connector 50 and a power cable 48*a* which extends from the battery 82.

The portable surface treatment tool 2 is the same as that in the embodiment illustrated in FIGS. 1 to 5. As shown in FIG. 9, the suction required for the tool 2 is provided by a separate cleaning machine, for example a separate scrubber dryer 68. In alternative embodiments, a source of suction is used which can be worn by the user, for example a source of suction which can be carried in the backpack 96. The portable surface treatment tool 2 can be used in the same manner as previously described.

Figure 10:
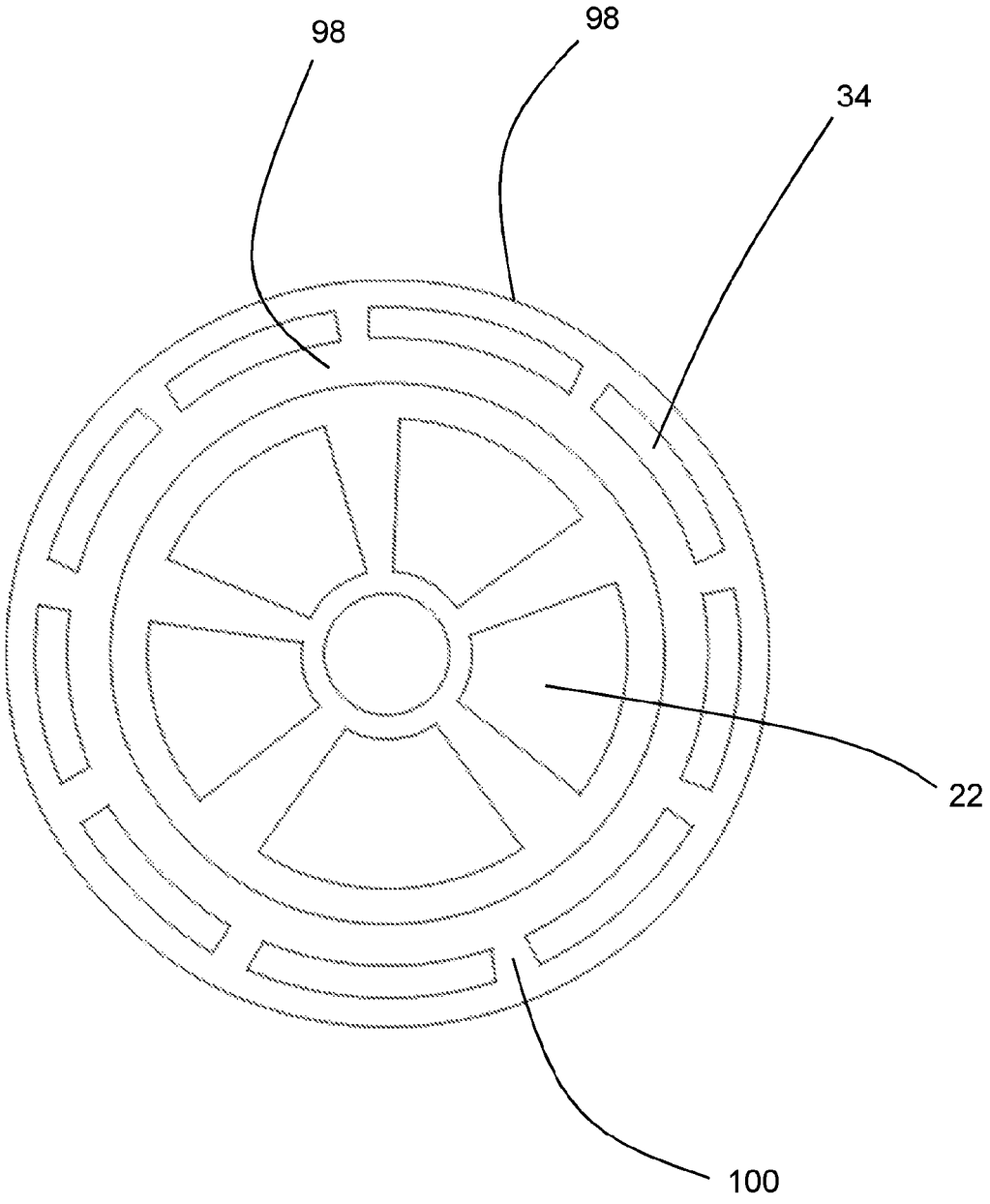
FIG. 10 shows a schematic illustration of the suction region of a tool head of a portable surface treatment tool in accordance with another embodiment of the disclosure.

An alternative embodiment of the portable surface treatment tool 2 is illustrated in FIG. 10. This embodiment is the same as that described in relation to FIGS. 1 to 5*b*, however in this alternative embodiment, a pair of resilient guide members 98 extend around the perimeter of the shroud 28 to form a suction region 34 in the form of a circular channel. Support ribs 100 are provided between the pair of resilient guide members 98 for structural support. This arrangement is advantageous in that the suction region 34 is continuous around the tool head 4 and so fluid is removed from the surface irrespective of the direction of movement of the tool.

Although the invention has been described in relation to one or more embodiments, it will be appreciated that various changes or modifications can be made without departing from the scope of the invention as defined in the appended claims. For example, it will be appreciated that any suitable fluid reservoir, pump, power supply, and/or suction controller may be used with the portable treatment tool. Further, power and fluid may be provided to the portable treatment tool by any of the configurations described herein. In some embodiments, the fluid reservoir, pump, power supply and/or suction controller are configured to be carried by the portable surface treatment tool.

The invention claimed is:

1. A portable surface treatment tool configured for attachment to a scrubber dryer machine, the portable surface treatment tool being configured for use with vertical, overhead, inclined and horizontal surfaces, the portable surface treatment tool comprising a head and a handle coupled to said head, wherein the head comprises:

a rotatable surface treatment unit configured to engage a surface to be treated;

a motor configured to drive the rotatable surface treatment unit; and a shroud containing at least a portion of the rotatable surface treatment unit, the shroud defining a suction region proximal the rotatable surface treatment unit wherein the suction region is configured to suck fluid from a surface to be treated, and wherein the shroud defines a suction connection formation configured to be coupled to a source of suction supplied by said scrubber dryer machine, the suction connection formation being in fluid communication with the suction region to remove fluid from a surface to be treated; wherein the shroud comprises a resilient guide member located proximal the rotatable surface treatment unit, wherein at least a portion of the resilient guide member is shaped to form at least one opening such that, when the portable surface treatment tool is in use, fluid can enter the suction region via said opening.

2. A tool according to claim 1, wherein the resilient guide member is a first resilient guide member and the shroud further comprises a second resilient guide member, wherein the suction region is defined by the first and second resilient guide members.

3. A tool according to claim 2, wherein the suction region is provided at a first portion of a perimeter of the shroud and a third resilient guide member configured to direct fluid flow on a surface is provided at a second portion of the perimeter of the shroud, wherein the first and second portions are provided opposite each other around the perimeter of the shroud.

4. A tool according to claim 3, wherein said first and second resilient guide members defining the suction region and the third resilient guide member are arranged to extend in a direction towards a surface to be treated when in use, and wherein said first and second resilient guide members defining the suction region and the third resilient guide member are arranged to extend around the perimeter of the shroud such that they define gaps between the first and second resilient guide members defining the suction region and the third resilient guide member.

5. A tool according to claim 4, wherein said first and second resilient guide members defining the suction region and the third resilient guide member are arranged to extend in a direction towards a surface to be treated when in use, and wherein the resilient guide members defining the suction region extend towards the surface by a greater distance than the third resilient guide member provided at the second portion of the perimeter.

6. A tool according to claim 1, wherein the portable surface treatment tool comprises a power connector configured to couple the motor to an external power supply to drive the rotatable surface treatment unit.

7. A tool according to claim 1, wherein the handle is an elongate handle arranged such that an end of the elongate handle is coupled to the head of the tool.

8. A tool according to claim 7, wherein the tool includes:

a) a suction hose coupled to the suction connection formation of the shroud, wherein an end of the suction hose distal the shroud is configured to couple to said scrubber dryer machine, optionally wherein the suction hose is configured to extend through or along a shaft of the elongate handle; and/or b) a power supply cable coupled between the motor and a power connector configured to couple to an external power supply, the power connector provided distal the tool head, wherein the power supply cable is provided through or along a shaft of the handle; and/or c) a fluid applicator mounted on the head of the tool, wherein the fluid applicator is configured to apply fluid to a surface to be treated, optionally wherein the tool further comprises a fluid supply pipe coupled to the fluid applicator and extending through or along a shaft of the handle, terminating at a fluid supply connector configured to couple to a fluid supply.

9. A tool according to claim 8, wherein a power cable and/or a fluid supply pipe extend through an interior hollow of the suction hose or is integrally formed with the suction hose.

10. A surface treatment system comprising a portable surface treatment tool according to claim 1, further comprising a scrubber dryer machine comprising a source of suction and configured to be coupled to the suction connection formation of the portable surface treatment tool to remove fluid from the suction region.

11. A surface treatment system according to claim 10, wherein the system further comprises a power supply configured to power the motor to drive the rotatable surface treatment unit; and/or wherein the system further comprises a fluid reservoir configured to be coupled to a fluid applicator mounted on the head of the tool and configured to apply fluid to a surface to be treated, optionally wherein the fluid reservoir is configured to be coupled to the fluid applicator via a pump.

12. A surface treatment system according claim 10, wherein the or a power supply and/or the or a fluid reservoir and/or the or a pump is provided by the scrubber dryer machine.

13. A shroud for a portable surface treatment tool comprising a rotatable surface treatment unit, wherein the shroud is configured for attachment to a portable surface treatment tool, the shroud defining a suction region wherein the suction region is configured to suck fluid from a surface to be treated, and wherein the shroud defines a suction connection formation configured to be coupled to a source of suction supplied by a scrubber dryer machine, the suction connection formation being in fluid communication with the suction region to remove fluid from a surface to be treated;

wherein the shroud comprises a resilient guide member located proximal the rotatable surface treatment unit, wherein at least a portion of the resilient guide member is shaped to form at least one opening such that, when the portable surface treatment tool is in use, fluid can enter the suction region via said opening.

14. A portable surface treatment tool configured for attachment to a suction controller, the portable surface treatment tool being configured for use with vertical, overhead, inclined and horizontal surfaces, the portable surface treatment tool comprising a head and a handle coupled to said head, wherein the head comprises:

a rotatable surface treatment unit configured to engage a surface to be treated;

a motor configured to drive the rotatable surface treatment unit; and a shroud containing at least a portion of the rotatable surface treatment unit, the shroud defining a suction region proximal the rotatable surface treatment unit wherein the suction region is configured to suck fluid from a surface to be treated, and wherein the shroud defines a suction connection formation configured to be coupled to a source of suction supplied by said suction controller, the suction connection formation being in fluid communication with the suction region to remove fluid from a surface to be treated;

wherein the shroud comprises a resilient guide member located proximal the rotatable surface treatment unit, wherein at least a portion of the resilient guide member is shaped to form at least one opening such that, when the portable surface treatment tool is in use, fluid can enter the suction region via said opening.

15. A surface treatment system comprising a portable surface treatment tool according to claim 14 and further comprising a suction controller comprising a source of suction and configured to be coupled to the suction connection formation of the portable surface treatment tool to remove fluid from the suction region.

16. A shroud for a portable surface treatment tool comprising a rotatable surface treatment unit, wherein the shroud is configured for attachment to a portable surface treatment tool, the shroud defining a suction region wherein the suction region is configured to suck fluid from a surface to be treated, and wherein the shroud defines a suction connection formation configured to be coupled to a source of suction supplied by a suction controller, the suction connection formation being in fluid communication with the suction region to remove fluid from a surface to be treated;

wherein the shroud comprises a resilient guide member located proximal the rotatable surface treatment unit, wherein at least a portion of the resilient guide member is shaped to form at least one opening such that, when the portable surface treatment tool is in use, fluid can enter the suction region via said opening.

17. A kit of parts for providing a surface treatment system, the kit comprising a portable surface treatment tool according to claim 1.

18. A kit of parts according to claim 17, wherein the kit further comprises a suction hose configured to couple the suction connection formation of the portable surface treatment tool to a scrubber dryer machine or suction controller to remove fluid from the suction region of the tool when in use, and/or wherein the kit comprises a pump configured to couple a fluid reservoir to the fluid applicator configured to be mounted on the head of the tool and configured to apply fluid to a surface to be treated in use.

19. A tool according to claim 2, wherein the first and second resilient guide members are coupled to each other at either end to form a continuous loop.

20. A tool according to claim 1, wherein at least a portion of the resilient guide member located proximal the rotatable surface treatment unit comprises openings for fluid to enter the suction region.

* * * * *